United States Patent [19]

Graffin

[11] Patent Number: 4,574,853

[45] Date of Patent: Mar. 11, 1986

[54] JET DIVIDER DEVICE FOR A FILLING HEAD

[75] Inventor: A. Jean-Jacques Graffin, La Ferte Bernard, France

[73] Assignee: Serac S.A., La Ferte Bernard, France

[21] Appl. No.: 621,627

[22] Filed: Jun. 18, 1984

[30] Foreign Application Priority Data

Jun. 24, 1983 [FR] France ..... 83 10508

[51] Int. Cl.[4] ..... B65B 1/04

[52] U.S. Cl. ..... 141/286; 141/392; 138/44; 239/DIG. 18

[58] Field of Search ..... 141/285-310, 141/392; 138/44; 239/DIG. 18

[56] References Cited

U.S. PATENT DOCUMENTS 4,402,485 9/1983 Fagerlund ..... 138/44

*Primary Examiner*—Bell, Jr. Houston S.

*Attorney, Agent, or Firm*—Cushman, Darby & Cushman

[57] ABSTRACT

In a preferred embodiment the jet divider device according to the invention comprises a series of frustoconical walls (2) having at the top a collar (3) projecting radially outwards, three radial arms (4) extending inwards and effecting the spacing of the members when a plurality of members of decreasing diameter are nested.

The assembly is disposed in a grid-carrier sleeve of a filling head and produces a radial component of the flow. During the flowing of a pulpy product, the elements of the pulp which would tend to straddle the top edges of the different members are thus subjected to a radial force and entrained by the liquid to be packed.

7 Claims, 2 Drawing Figures

JET DIVIDER DEVICE FOR A FILLING HEAD

FIELD OF THE INVENTION

The present invention relates to a jet divider device for a filling head.

PRIOR ART

Machines intended for filling liquids have various types of shut-off valves or distributor cocks. In addition, in order to keep the liquid in suspension by surface tension effect and thus to avoid, after closure, the formation of drops which would soil the packing which had just been filled, jet divider devices, such as grids made of intercrossing wires or a perforated plate, are provided.

Furthermore, it has been observed that certain liquids, such as fresh milk, fruit juice or products containing ammonia, tend to froth during filling and to disturb the filling operation. The use of jet divider devices, such as grids or perforated plates, has the effect of creating locally a laminar flow which reduces the amount of froth produced and improves filling.

These devices are generally satisfactory, but in the case of liquids containing pulp, such as orange juice or guava juice, the pulps tend to straddle the flow divider members and to be held in that position by the flow pressure. The amount of pulp thus retained by the jet divider tends to increase rapidly and to form a mat of pulp completely obstructing the openings in the jet divider device and blocking the flow of the product to be packed. It is then necessary to remove the filling head and empty the jet divider device of the pulp contained in it. Apart from the consequent waste of time, this entails handling of the various parts of the filling head, which is particularly detrimental in the case of the packing of a product which should be packed under aseptic conditions.

It is possible to avoid the clogging of the jet divider by increasing the size of the openings in the grid or perforated plate, but in that case the flow in the jet divider device will no longer be laminar, and once again the problems of frothing mentioned above will arise.

SUMMARY OF THE INVENTION

The present invention has the object of proposing a jet divider device for filling heads, which has a structure making it possible to achieve a continuous flow of pulps or other stringy elements contained in the liquid, while maintaining a laminar flow which prevents the emulsification of the product as it falls into the packing container.

In order to attain this object, according to the invention a jet divider device for filling head is provided, which comprises a series of members effecting partitioning transversely to the flow, together with a means giving a transverse component locally to at least a part of the flow.

According to one, more particular, characteristic of the invention, the partitioning members are concentric annular members axially offset in relation to one another, and the means imparting a transverse component is composed of a collar projecting in relation to the wall of the annular members.

According to other more particular characteristics of the invention, the collar carried by an annular member is perpendicular to the wall of the latter and is disposed at the top part of the annular member, the annular members are frustoconical in shape, and they are held in a spaced relationship by means of at least three radial arms extending in the opposite direction to the collar.

BRIEF DESCRIPTION OF THE DRAWINGS

Other characteristics and advantages will emerge in the course of the folllowing description, which is given with reference to the accompanying drawings, in which.

DETAILED DESCRIPTION

Figure 1:
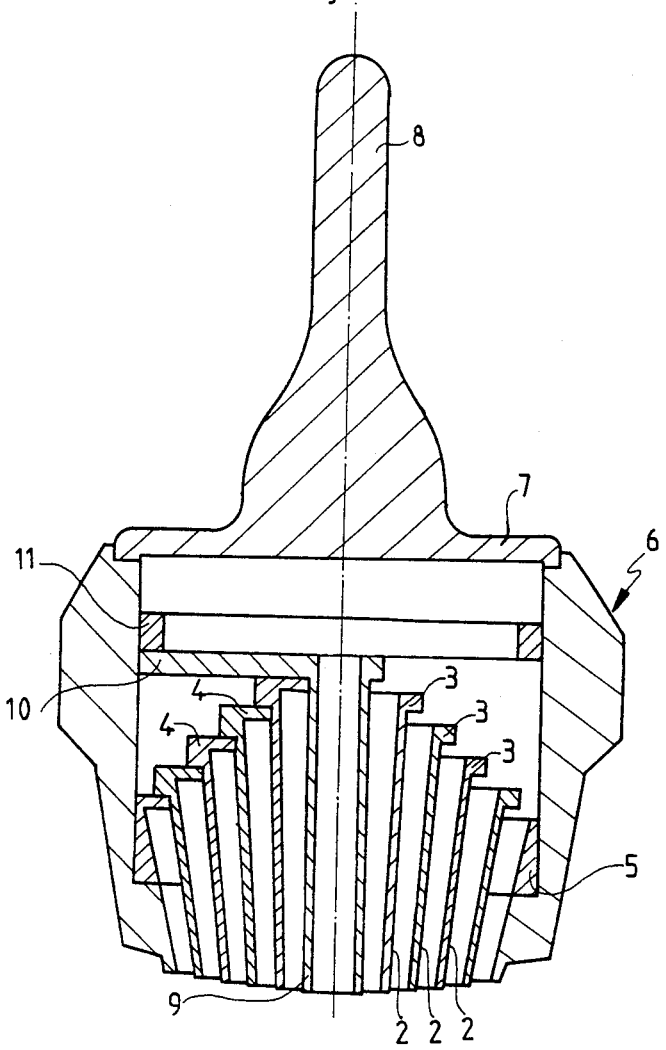
FIG. 1 is a view in diametrical section, taken on the line I—I in FIG. 2, of a grid-carrier sleeve equipped with a jet divider device according to the invention.
Figure 2:
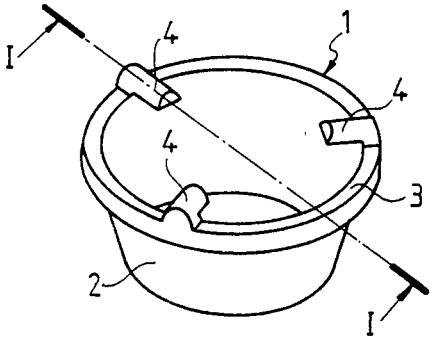
FIG. 2 is a view in perspective, on a larger scale, of a partitioning member in the jet divider device according to the invention.

Referring to the drawings, the device according to the invention comprises a series of partitioning members given the general reference 1 and being in the form of annular frustoconical members 2 of various diameters, having at the top a collar 3 projecting radially in the outward direction. Each member 1 has in addition three radial arms 4 extending inwards, so that a plurality of members 1 of decreasing diameter can be nested one in the other, the collar 3 of each member then resting on the inner ends of the arms 4 of the member 1 which has the next larger diameter.

In the embodiment illustrated, the members 1 have a length decreasing from the member of smallest diameter to the member of largest diameter, so that when the various members are nested they constitute an assembly having a bottom edge at a substantially uniform level.

Moreover, in the embodiment illustrated, the member of largest diameter, designated 5, has no external collar and has a substantially cylindrical external surface, so that its outside surface and its bottom surface bear on an internal shoulder formed in a grid-carrier sleeve given the general reference 6. In this connection, it will be noted that the member 5 could have a construction exactly identical to that of the other collar members 3, bearing then on the internal shoulder of the sleeve 6 and the frustoconical portion extending towards the bottom of the sleeve.

In the embodiment illustrated, the grid-carrier sleeve is also provided with a cross arm 7 supporting a finger 8, which makes it possible to clean the filling head without removing the grid-carrier sleeve, as is described in French Pat. No. 2 290 259. A characteristic of this kind is quite obviously not necessary for the correct functioning of the jet divider device according to the invention, which can be fitted to any grid carrier member, whether removable or not.

As can be seen in FIG. 1, in the embodiment illustrated the central partitioning member 9 is generally cylindrical and has three radial arms 10 substantially similar to the arms 4, but in this case they extend outwards and on them bears an annular washer 11 driven by force into the sleeve 6 in order to hold in place the different members 1 of the jet divider device. Once again, an arrangement of this kind is not strictly necessary for the correct functioning of the jet divider device according to the invention. The central member can in fact be frustoconical like the other members; it may also be solid, but a hollow member is always preferable because it improves the quality of the jet. Similarly, it is possible to adopt other means for holding the jet divider device in place, without thereby departing from the scope of the invention.

During the filling, each collar 3 will, at least partially, form a baffle with the top edge of the member 1 immediately adjacent, and the flow of liquid, while being divided, will be oriented locally at this level radially towards the interior, so that a pulp which would tend to take up position straddling the top edge of a member 1 will be entrained radially, and will therefore flow with the liquid, thus preventing the clogging of the filling head. In this connection it will be noted that the arms 4 are sufficiently spaced apart to make it impossible for the pulp to form a bridge between them. Any pulp which straddles these arms will slip off after some time, so that no accumulation will occur.

It can be clearly seen that other embodiments can be adopted without departing from the scope of the invention. In particular, the members 1 may be cylindrical members, or on the contrary they may have a more pronounced frustoconical shape, while the pyramid effect of the different members 1 nested one in the other can be increased by disposing the collars 3 at a level, on the wall 3, which is offset from the top edge of the wall. It is in fact the cooperation of a collar with the top edge of the adjacent member that is important, and not the cooperation of the top edges with one another. Moreover, the collars can be disposed inside the walls 2, while the arms 4 extend outwards, the pyramid shape of the top edges of the members 1 then being inverted in relation to that shown, and the radial component of the flow would then be from inside to outside. It will also be noted that the collar is not necessarily perpendicular to the wall of the member 1, but must simply have a position suitable for generating a transverse component at the top edge of the adjacent member.

The present invention is not limited to the examples of embodiment which have been described above, but on the contrary is capable of modifications and variants which will be clear to those versed in the art.

I claim:

1. A jet divider for a filling head comprising a plurality of annularly shaped flow divider members, each having a diameter that is greater than the next radially inwardly disposed said member, said members each being concentrically disposed relative to one another about a central axis, each said member having a first edge and a collar means on said respective upper edge, each said member having a second edge spaced from said respective first edge so that, when flow is presented to said jet divider generally parallel to said central axis and impinging on said collar means and flowing toward said second edges, said collar means will divert the flow at least partially from the generally inward direction to present accumulation of material across adjacent said collar means.

2. A jet divider device for filling heads which comprises a series of member for effecting partitioning of a flow, each said member having a means for imparting a transverse flow component locally to at least a portion of the flow.

3. The device as claimed in claim 2, wherein the partitioning members are concentric annular members axially offset in relation to one another, and wherein the means imparting a transverse component is composed of a collar projecting in relation to the wall of the annular members.

4. The device as claimed in claim 3, wherein the collar carried by an annular member is perpendicular to the wall of the latter.

5. The device as claimed in claim 2, wherein the collar is disposed at the top part of each annular member.

6. The device as claimed in claim 5, wherein at least one of the annular members is frustoconical.

7. The device as claimed in claim 3, wherein at least one of the annular members has at least three radial arms extending in the opposite direction to the collar.

* * * * *